United States Patent [19]

Fredriksson et al.

[11] Patent Number: 4,519,439

[45] **Date of Patent: * May 28, 1985**

[54] METHOD OF PREVENTING FORMATION OF SEGREGATIONS DURING CONTINUOUS CASTING

[75] Inventors: Hasse Fredriksson, Stockholm; Lars Tiberg, Fatersta, both of Sweden

[73] Assignee: Jernjontoret, Stockholm, Sweden

[ * ] Notice: The portion of the term of this patent subsequent to Jan. 5, 2002 has been disclaimed.

[21] Appl. No.: 468,976

[22] Filed: Feb. 23, 1983

Related U.S. Application Data

[63] Continuation-in-part of Ser. No. 819,214, Jul. 26, 1977.

[51] Int. Cl.[3] ..... B22D 11/12

[52] U.S. Cl. ..... 164/476; 164/486

[58] Field of Search ..... 164/487, 476, 441, 442, 164/447, 448, 417, 270.1, 486, 444

[56] References Cited

U.S. PATENT DOCUMENTS

| | | | |
|---|---|---|---|
| 3,773,099 | 11/1973 | Rossi | 164/442 X |
| 3,938,584 | 2/1976 | Meylan | 164/442 |
| 3,946,797 | 3/1976 | Thalmann | 164/442 |
| 3,974,559 | 8/1976 | Kawawa et al. . | |
| 4,000,771 | 1/1977 | Williamson | 164/486 X |

*Primary Examiner*—Nicholas P. Godici
*Assistant Examiner*—J. Reed Batten, Jr.
*Attorney, Agent, or Firm*—LeBlanc, Nolan, Shur & Nies

[57] ABSTRACT

A method for preventing segregations in continuous casting by deforming the continuous strand plactically during the solidification in such a way that the cross-sectional area of the strand is physically reduced on a mount corresponding substantially to the solidification and cooling shrinkage of the material along the solidifying strand length. The method avoids upward or downward transport of melt in the solidifying strand. The reduction in most cases will be 2–6% and can be accomplished with apparatus having a number of pairs of strand reducing rolls or jets along the strand, to reduce it a number of times, each time less than the total desired reduction. The degree of reduction of the strand from casting to the final strand corresponds to the solidification and cooling shrinkage.

8 Claims, 14 Drawing Figures

METHOD OF PREVENTING FORMATION OF SEGREGATIONS DURING CONTINUOUS CASTING

RELATED APPLICATIONS

This application is a continuation-in-part of Ser. No. 819,214, filed July 26, 1977. The entire disclosure of Ser. No. 819,214 is hereby included by reference as though fully set forth herein.

BACKGROUND OF THE INVENTION

This invention relates to a method and an apparatus for preventing the formation of macro-segregations in continuous metal casting, and particularly carbide segregations.

In the continuous casting of high-carbon steels, for example ball bearing steels, high-speed tool steels and also other steels with high carbon content, distinctive carbide segregations appear which render the material unsuitable for many fields of application. The same kind of carbide segregations also can arise when the aforesaid steels are cast in conventional molds and during ESR-remelting at high melting rates.

Carbide segregations are formed during the solidification of the inner parts of an ingot. Due to the large solidification intervals of the steels, relatively thick zones of semi-solidified material are formed therein. In said zones dendrites form a porous network of solidified metal with a lower than average content of impurities in the material. Residual molten metal with higher carbon content is located in the intermediate spaces between the dendrites. During the solidification, the metal shrinks, partly as solidification shrinkage of about 4% and partly as cooling shrinkage in metal already solidified.

The metal or material solidifies from the outer surfaces inward to the center of the material. This results in several solidification front existing during the solidification process which grow toward the material center. In continuous casting, furthermore, a strand with unsolidified material in the center moves from a mold downward. Depending on the dimensions of the strand and its casting rate, the solidification zone, i.e., the zone within which semi-solidified material is present, varies in the longitudinal direction of the strand with respect to length and other dimensions. When the solidification zone has an unfavorable configuration, i.e. when it is long and thick, high stresses arise between the solidification fronts of the solid and semi-solidified zones. These stresses arise due to a difference in the cooling rate between the shell surfaces and the interior solid dendrite phase. As the material solidifies the solidification front is moved towards the center of the strand. Hereby, the temperature decreases when the solidification front passes. This decrease is often higher than the temperature decrease at the outer surface. This is the case when the solidification fronts meet in the center.

Thus, the stresses arise due to a temperature difference between the solid surface and the solid interior phase. As a result of these stresses, the fronts separate. The shrinkage gives rise to a pressure differential, which sucks down the melt through the porous semi-solidified material. This melt is enriched with impurities and alloying elements and, consequently, macro-carbide segregations are formed in the center of the strand. Corresponding macro-segregation conditions prevail for all alloys with large solidification intervals and give rise to segregations. These macro-segregations occur with respect to all alloying and non-metallic elements present in molten metals.

When the solidification zone is long, the metal solidifies and shrinks in the central portions of the strand, relatively large amounts of melt must be transported to the semi-solified zone. As a result thereof, substantial macro-segregations arise which form pores and cracks in the central portion. In continuous casting it is also known that carbide segregations can be reduced by carrying out the casting very slowly. The casting rate, however, in that case must be reduced so much that the process is uneconomical.

A process for controlling continuous casting against the formation of center segregation and center porosity is described in U.S. Pat. No. 3,974,559 to Kawawa et al. According to this process, a continuous casting is formed in a mold 11 and is then passed through a secondary cooling zone 12 in order to form a thick solidification shell on the strand. Thereafter, a series of reducing rolls are positioned at the front portion of the crater end within the strand in order to check the movement of the molten steel which contains impurities concentrated by reasons of the previous solidification within the secondary cooling zone. This patent discloses and claims that the reduction rate should be less than 1.5% for each pair of the reducing rolls in order to avoid center cracks which can be formed by too great a reduction in the slab thickness. This patent does not recognize the problem of macro-segregations across the ingot cross-section and along its length during a continuous casting operation and the related problems caused by the concentrated impurities within the liquid phase. Also, the disclosure of this patent does not take into the account the effects of the cooling shrinkage in the semi-solidified phase and in the surrounding solid metal shell but rather focuses its entire discussion on the minimum reduction rate on the rate of solidification shrinkage in the front end of the crater end within the strand in order to present a solution for the problem of center segregation and porosity. The fact is that it is not possible to eliminate the macro-segregations by only compensating for solidification shrinkage. Elimination of macro-segregations can only be effected by taking solidification shrinkage as well as cooling shrinkage in the solid and semi-solid phases into account. This was apparently not realized by Kawawa et al.

The method disclosed by Kawawa et al cannot be used on the strand just below the mold because the high reduction rate utilized would cause the molten metal to be pressed upward into the tundish since the solid shell of the strand constitutes only a small portion of the cross-sectional area. The Kawawa patent is premised on first forming a substantial solid shell on the strand during which time impurities are concentrated in the molten phase and to then press the concentrated molten steel backward from moving toward the front of the crater end. In this manner, a positive forcing of the concentrated molten steel backward along the strand length occurs as an integral part of the process.

SUMMARY OF THE INVENTION

The applicants of the present invention have discovered macro-segregation fluid flow mechanics which can be used as the basis for a casting process in which transport of molten steel either upwardly or downwardly in the ingot is prevented. This has been done by the enunciation of a theoretical model, consisting of a differential material balance equation, which can be solved in a manner to determine the necessary deformation rate in order to prevent flow of molten metal either upwardly or downwardly along the ingot in the case of a vertical casting machine or backward and forward in the case of a horizontal casting machine. The process evolved requires the successive application of deformation roll pairs from immediately below the mold until the point where the ingot strand has completely solidified.

The result of the practice of this process is the attainment of a goal long sought in the continuous casting industry of producing a strand of constant composition across the transverse cross-section and longitudinally along the strand length as well.

The present invention relates to a method of preventing the aforesaid formation of macro-segregations during continuous casting. The invention is characterized in that the cast strand during solidification is subjected to plastic deformation, so that the cross-section area of the strand is reduced from just below the mold to in a series of steps to degree specified by the described theorectical model which has been heretofore available.

The invention is described in greater detail in the following, with reference to the accompanying drawings.

DESCRIPTION OF THE PREFERRED EMBODIMENTS

Figure 1:
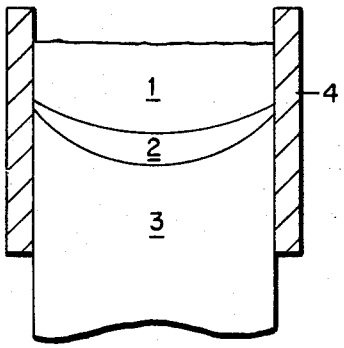
FIGS. 1 and 2 each are schematic longitudinal cross-sectional views through a strand and associated mold.

The formation of suctions, stresses and cracks in a semi-solidified area depends on the configuration of the solidification zone. FIG. 1 shows a solidification zone having a favorable configuration with respect to suctions, stresses and cracks, because the semi-solidified material 2 has a short extension in the vertical direction, i.e. in the longitudinal direction of the strand. The semi-solidified material 2 is surrounded by molten material 1 and solidified material 3. A mold 4 encloses the strand 1, 2, and 3. A solidification zone of the configuration shown in FIG. 1 arises at a very low-rate continuous casting, at normal ESR-recasting and at the casting of a thick, short ingot.

Figure 2:
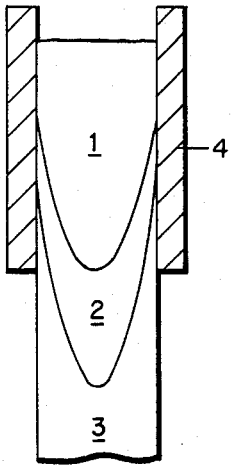

FIG. 2 shows a solidification zone having an unfavorable configuration, because the semi-solidified material 2 has an enlarged vertical extension. This type of solidification zone is formed during normal and rapid continuous casting, high-rate ESR-remelting and the casting of a long, narrow ingots. When a metal, which is cast by normal or rapid continuous casting, as in FIG. 2, shrinks at the center, relatively large amounts of melt 1 are transported downward from above due to the relatively large area with semi-solidified material. As a result thereof, substantial segregations arise, as mentioned above, over a larger area, in the form of so-called macro-segregations, which give rise to pores and cracks in the central portion and variations in composition in the transverse and longitudinal directions. The process described with reference to FIG. 2 is the normal process during continuous casting. The casting rate is so high, that the solidification zone is relatively long. The above known technique for preventing carbide segregations consists of low-rate casting whereby a small solidification zone, according to FIG. 1, is formed. This process, however, has an unfavorable economic result.

Figure 3:
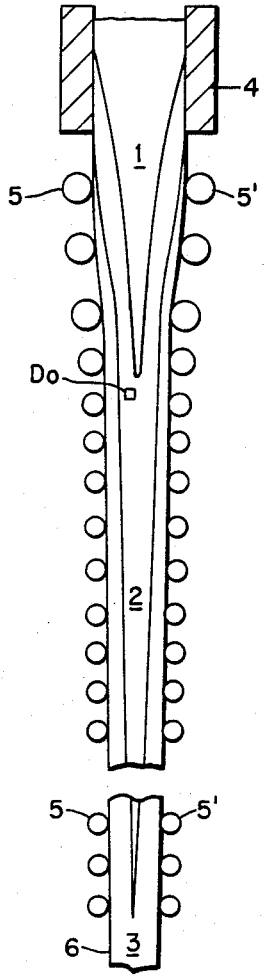
FIG. 3 is a schematic longitudinal cross-sectional view through a strand and associated vertical casting machine for effecting plastic deformation of the strand according to the present invention.

According to the present invention, the strand is deformed plastically so that the cross-sectional area reduction substantially corresponds to the solidification and combined cooling shrinkages of the material as further detailed herein. Preferably, the plastic deformation of the strand is effected from immediately below the mold as shown in FIG. 3 to the position where the strand is fully solidified. This reduction length extends from the top position where the strand has all three phases of solid, semi-solid, and liquid present to the fully solid position. When the central portions solidify and this material shrinks by solidification, the strand is subjected to a reducing working so that its cross-section area is reduced to a dimension corresponding to the area of the solidified and entirely welded-together material over the cross-section area of the strand. Due to this process, melt cannot be sucked down into the semi-solidified material 2 or pushed back up into the mold. Consequently, the formation of macro-segregations in the transverse and longitudinal directions and along the length as well as of pores and cracks in the central portions are prevented. In order to attain this result, it is necessary to carry out the successive reduction steps in a precise manner which is determined by a valid theoretical understanding of the macro-segregation process.

In FIG. 3 a device is shown, by which a working operation for deforming the strand can be carried out. The molten metal is poured down through the mold or chill 4 and solidifies substantially immediately on the surface. The solidified strand is passed down and out of the mold 4, and thereafter is introduced between a plurality of roll pairs 5—5'. Each of the roll pairs 5—5' has a spaced relationship between the rolls which brings about an area reduction corresponding to the theoretically derived deformation rate required at each roll pair. The strand 6, thus, from the first roll pair and downward is subjected to deformation forces so that it is entirely welded-together at its center after completion of the process. No cooling section is interposed between the mold and the first of the roll pairs. After the last roll pair, the strand is entirely solidified. Due to this successive working, the molten metal 1 (so-called "melt") will not be forced upward or downward through the semi-solidified metal. This process is described below by reference to a theoretical model which forms the basis for the present invention.

MOLTEN FLUID FLOW MECHANICS

Figure 4:
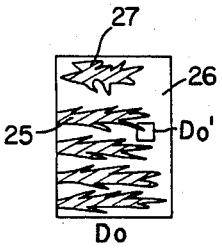
FIG. 4 is a schematic representation of solidifying dendritic structure in a semi-solid domain $D_0$ of FIG. 3.

Referring now to FIG. 4, the microscopic semi-solid domain $D_0$ shown in FIG. 3 is shown enlarged with solid dendrites 25 forming therein by solidification of the liquid metal 26 which is within the semi-solidified material 2. The dendrites can be attached to the internal matrix formed by the solidified metal 3 or can be relatively free-floating in the solidifying matrix within the semi-solidified zone 2 as shown by dendrite 27.

Figure 5:
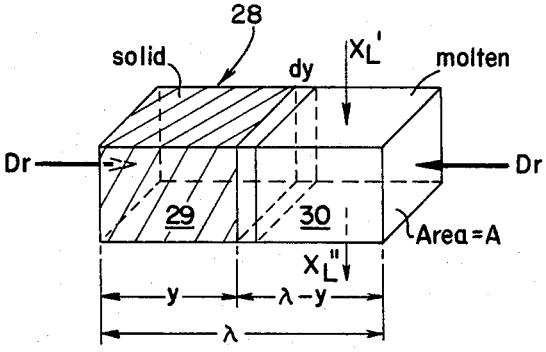
FIG. 5 is an enlarged schematic domain volume taken from within the semi-solid phase portion $D_0'$ of FIG. 4 which has been labelled according to the theoretical model described herein.

FIG. 5 shows a semi-solidified domain volume 28 within the microscopic metal domain $D_0'$ identified in FIG. 4. This volume 28 has a solid portion 29 and a molten portion 30 and thus represents the solidification interface. Within volume 28 the solidification portion can be defined as A·dy, where A is the cross-sectional area of the domain volume and dy is the incremental growth of the solid portion 29 over a given time period. The solidification shrinkage resulting from dy changing phase and physical properties from liquid to solid is one of the causes of molten metal to be sucked down into the liquid phase 30. This solidification shrinkage described in microcosm for volume 28 is repeated for all such domain volumes within the semi-solidified zone 2 of FIG. 3. In aggregate, this shrinkage process causes liquid metal to flow into volume 28 and also to be drawn through each such domain volume. Another cause of this molten metal flow is the cooling shrinkage as detailed below.

Figure 6:
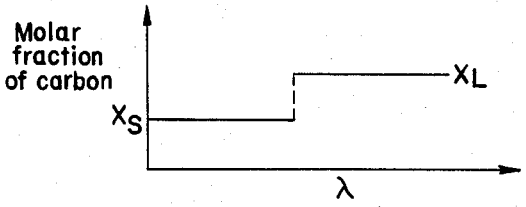
FIG. 6 is a schematic graph of the molar fraction of carbon in the solid and in the liquid phases of the enlarged metal domain shown in FIG. 5.

As shown by FIG. 6, the molar fraction or concentration of carbon in the solid phase 29 of FIG. 5 is denoted as $X_s$ and is lower than the fraction in the liquid phase 30 which is denoted as $X_L$. This concentration differential described for carbon is also a phenomenon encountered for other elements such as sulphur and phosphorous which together with carbon and other elements cause macro-segregation problems in continuous cast metal strands. The concentration of these elements tends to increase in the liquid phase over the duration of the casting operation and to thus produce macro-segregation across the ingot cross-section as well as along its length. By casting according to the present invention such macro-segregation can be controlled and thus be avoided.

THEORY OF INVENTION

The theoretical basis on which the invention rests can be described by reference to FIGS. 5 and 6 in terms of a generalized material balance equation for domain volume 28. The concentration of a given alloying or non-metallic element in the liquid metal flowing into the volume 28 is denoted as $X_L'$ and the concentration of that element in the outgoing liquid metal which is drawn through the liquid phase portion 30 due to solidification and cooling shrinkage in other domain volumes within the semi-solidified zone 2 is referred to as $X_L''$. The molar fraction in the solid phase can be generally expressed by the symbol $X_s$ and in the liquid phase by $X_L$. These concentration measures are expressed as molar fractions so that the total of all such elements is unity as follows:

$$1 = X_C + X_S + X_P + X_{Fe} + X_{other\ elements} \qquad \text{Eq. (1)}$$

For carbon, C, the molar fraction is calculated as:

$$X_C = \frac{\frac{\%\,C}{M_c}}{\frac{\%\,C}{M_c} + \frac{\%\,S}{M_s} + \frac{\%\,P}{M_p} + \frac{\%\,Fe}{M_{Fe}} + \Sigma\frac{\%\,E}{M_E}} \qquad \text{Eq. (2)}$$

where, M=molar weight of each of the designated elements identified by periodic chart subscripts and E=other alloying or non-metallic elements which are present in the melt such as Si and Mn.

Next an expression is formulated for the material balance for the domain volume 28 of FIG. 5 considering that an incremental volume dy·A solidifies over a given time period. This balance for any one of the alloying or non-metallic elements, E, can be used to construct a general expression from the following terms for which reference to FIG. 5 should be made for the cross-sectional area, A, and dimensions λ and y of the domain element 28:

I. Moles of E in the solid phase volume $y \cdot A = \frac{X_s \cdot y \cdot A}{V_m^s}$ Eq. (3)

II. Moles of E in the liquid phase volume $(\lambda - y) \cdot A = \frac{X_L (\lambda - y) \cdot A}{V_m^L}$ Eq. (4)

III. Moles of E entering domain volume $\lambda \cdot A = \frac{X_L'}{V_m^L} \cdot Vin$ Eq. (5)

IV. Moles of E leaving domain volume $\lambda \cdot A = \frac{X_L''}{V_m^L} \cdot Vout$ Eq. (6)

V. Moles of E in the solid phase $y \cdot A$ after solidification of incremental volume $dy \cdot A = \frac{(y + dy)(X_s + dX_s)}{V_m^s} \cdot A$ Eq. (7)

VI. Moles of E in the liquid phase $(\lambda - y) \cdot A$ after solidification of incremental volume $dy \cdot A = \frac{[\lambda - (y + dy)][X_L + dX_L]}{V_m^L} \cdot A$ Eq. (8)

Where:

$X_s$=molar fraction of E in the solid phase volume y·A $V_m^s$=molar volume of the solid phase y·A $X_L$=molar fraction of E in the liquid phase volume (λ−y)·A $V_m^L$=molar volume of the liquid phase (λ−y)·A $V_{in}$=volume of liquid entering the domain volume λ·A $V_{out}$=volume of liquid leaving the domain volume λ·A The material balance can then be formulated as follows using the above defined terms:

$$I + II + III - IV = V + VI \qquad \text{Eq. (9)}$$

where the symbolized terms are as defined above in equations 3 through 8. The resulting material balance is a differential equation and can be solved by a computer run for any alloying or non-metallic element, E. The solution of the equation describes the content of element, E, in volume element 28 when the solidification process has been completed, i.e. formation of a solid cast ingot. This is also a description of macrosegregation. For avoidance of macrosegregation the moving strand must be reduced in thickness at a deformation rate, $D_r$, over the semi-solidified region so that $$V_{in}=V_{out}=0 \quad \text{Eq. (10)}$$

whereby liquid metal flow through the liquid phase 30 of domain volume 28 in FIG. 4 is prevented.

The required deformation force must be applied immediately below the mold and throughout the cast ingot length to the position where the ingot has a solid cross-section since macro-segregation phenomenon occurs during the entire casting time period at economical casting rates. It is insufficient to permit a substantial ingot wall thickness to form first and to then apply outside deformation forces since considerable macrosegregation will have already occurred in the metal forming such an ingot wall; thus resulting in variation in concentration of all of the elements, E, both across the ingot and along its length.

The above material balance differential equation (9) can be solved in a manner to obtain the necessary deformation rate, $D_r$, in order to satisfy the condition of equation (10) above. The necessary deformation rate, $D_r$, is determined by considering the physical properties of the strand at each deformation position along the length of the ingot. The force between opposing rollers in each roller pair 5 is set accordingly. The solution of equation (9) thus produces a model by which the deformation necessary to fully compensate gainst flow through each domain volume and thus to compensate for solidification shrinkage in the entire strand as well as to compensate for cooling shrinkage.

From equation (9) it can be determined that the solidification shrinkage $S_{sh}$ when incremental volume dy·A solidifies is described by:

$$S_{sh}=\left[\frac{V_m^L}{V_m^s}-1\right] dy\cdot A \quad \text{Eq (11)}$$

where the terms are as above defined. This equation can be solved for the deformation rate necessary to compensate for solidification shrinkage in terms of dy. The term, dy, can then be calculated from cooling shrinkage data.

Two additional factors also enter into the determination of the necessary deformation rate, $D_r$. Compensation must be made for the cooling shrinkage of the solid material in the semi-solidified zone, represented by molten volume 30 in FIG. 5. This shrinkage otherwise causes liquid metal to be sucked down into the zone. Such shrinkage equals $\alpha\cdot\Delta T\cdot 1$ where $\alpha$ is the coefficient of thermal expansion (or contraction), $\Delta T$ is the decrease in temperature and 1 is a unit length.

Further, one must compensate for cooling shrinkage of the solid material surrounding the semi-solidified area. This material will, when cooling, deform the soft semi-solidified material, whereby this cooling shrinkage will be a positive contribution to the deformation of the strand.

Equation (10) gives the condition for avoiding macrosegregations. This condition is expressed as in equation (12) below, which means that the deformation rate ($D_r$) is equal to the algebraic sum of all different shrinkages.

To sum up, equation (12) gives the deformation rate of the strand by external force on its surface over a given time period, for avoiding marco-segregations as follows:

$D_r$ = Deformation Rate = {Solidification shrinkage + Cooling shrinkage} in the semi-solidified area − {Cooling shrinkage} in the surrounding solid area. Eq. (12)

In the above theoretical model it is assumed that no plastic deformation occurs due to thermal stresses only, i.e., that the thermal stresses do not reach such a magnitude.

The described theoretical model embodied in equations (9) to (12) and the supporting equations permits calculation of the extent to which the ingot strand must be deformed in order to fully avoid macro-segregations. When the necessary deformation rate, $D_r$, is attained at multiple positions along the length of the solidifying ingot the concentration of carbon, sulfur and other non-metallic elements as well as alloying elements can be controlled so as to be uniform across the ingot cross-section and along its length.

Control against macrosegregation over the length of the continuous cast strand has not been heretofore possible since the molten phase fluid flow mechanics which form the basis for the above described theoretical model had not been known until enunciated by the inventors of the present invention. The continuous casting of ingots having uniform properties and composition in both transverse and longitudinal directions is now possible due to the formulation of the described theoretical model which represents the general solution to the problem of controlling against macrosegregations in continuous cast metal strands and is thus a commercial development of broad implications. The compensation for the solidification and cooling shrinkages must start immediately below the mold and this is practical due to the large static pressure of the molten steel against which the reducing rollers work. More specific operational aspects of using this theoretical model in practice are described below.

Figure 7:
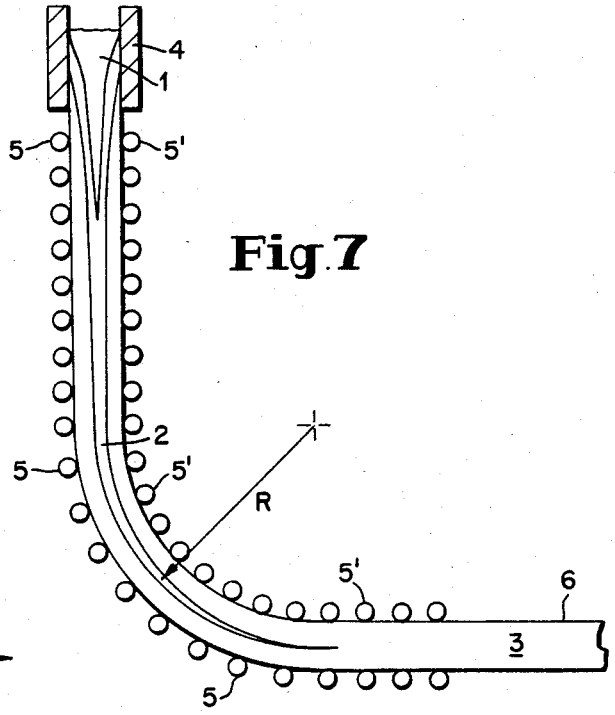
FIG. 7 is a schematic representation of the apparatus of the present invention applied to a horizontal casting machine.

FIG. 7 shows the apparatus of the present invention applied to a horizontal casting machine in which the solidified ingot 6 is disposed in a horizontal direction. As in FIG. 3 molten metal 1 is surrounded in the lower parts of mold 4 by the semi-solid phase 2 which is further solidified to form the solid phase 3 in the horizontal casting machine. A series of roller pairs 5—5' are utilized as reduction rolls from a position immediately below the mold 4 until the point where the ingot strand has completely solidified. The number of rolls, the bending radius, R, depend upon the metal being cast, the cooling rate, and the dimensions of the strand, etc.

In both FIGS. 3 and 7 the first reduction roller pair 5—5' is used to plastically deform the ingot strand at the position where the strand consists of a solid metal skin of only a few centimeters in thickness and this position usually occurs about 1 meter below the top of the liquid phase surface within mold 4.

In the continuous casting of workpieces with rectangular cross-section, so-called slabs, the corners and portions adjacent thereto are cooled much more rapidly than the remaining parts of the strand. As a result thereof, the solidification shrinkage, which causes the sucking down of melt 1 into the semi-solidified material 2, takes place in the central strand portions, which solidify at a later time. This implies that only the broad sides of a strand with rectangular cross-section shall be worked. It is accentuated thereby that a strand, due to the stronger cooling at the corners, tends to assume a greater thickness at the center of the broad sides where the material is hotter.

Figure 8:
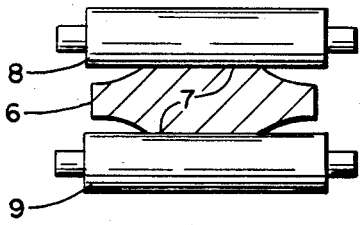
FIGS. 8–10 are each schematic cross-sections of a strand during plastic deformation.

FIG. 8 shows in a schematic way a device according to an embodiment of the invention, at which only a portion of the broad sides of a strand is intended to be worked. A strand 6 with convex broad sides 7 is cast in a mold 4 (see FIG. 3) and worked between two plane rolls 8, 9. Thereby only that portion of the convex broad sides is worked which has contact with the plane rolls. After the working, the strand has a reduced cross-section area, because the strand has assumed a less convex configuration while the areas at the corners of the strand are substantially unworked. The convexity of the strand can be adjusted at casting so that, as a result of the necessary reduction of the cross-section by working with rolls, the strand after the working has a rectangular cross-section.

The reduction of the strand according to the embodiments described above and in the following must be so great, that it slightly exceeds the reduction in area which corresponds to the solidification shrinkage occurring. The reduction must be carried out in multiple steps, as indicated in FIG. 3, so that a substantially continuous area reduction is obtained which is adjusted to and corresponds to the deformation rate specified by the above theoretical model. Thensile stresses in the solidifying material are hereby avoided and only moderate compressive stresses are obtained. The number of reduction steps is determined by practical factors, especially by the casting rate and, thereby, the length of the solidification zone. In high-speed continuous casting machines, with a solidification zone length of up to 20 meters, the working can take place in 20 to 40 steps, i.e. roller pairs, while in slower operating machines, for example an ESR-machine, the working is carried out in a few steps.

A suitable total reduction of the cross-sectional area of the strand generally is 1–10%, preferably 2–6%. For steel, a suitable reduction generally is 4%.

The rolls 8, 9 are arranged to rotate at the same circumferential speed as the rate of the cast strand at said roll pair. A plurality of roll pairs similar to the roll pair 8, 9 can be positioned with different spaced relationship to the mold, as shown in FIG. 3.

Figure 9:
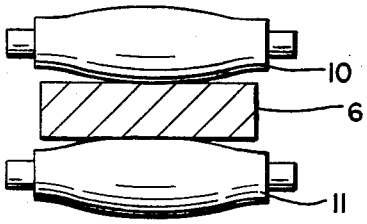

Another embodiment is shown in FIG. 9, according to which the strand 6 is cast with rectangular cross-section and plane broad sides, and the working is carried out with rolls 10, 11, which are cambered, i.e. so designed as to have a diameter decreasing from the center to both ends. According to this embodiment, a strand is obtained after the working which has the smallest thickness at its center and increasing thickness to the short sides of the substantially rectangular cross-section of the strand. In general, the above information with respect to the plane rolls 8, 9 according to FIG. 8 and the roll pairs in FIG. 9 applies also to this embodiment. A corresponding working of strands with square cross-section, octagonal cross-section round cross-section or a cross-section of another shape can be carried out by means of tools, which enclose the strand as completely as possible, because the cooling of the strand at such cross-sections is more symmetrical than for strands with rectangular cross-section.

Figure 10:
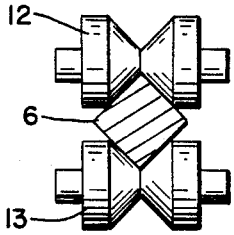

In order to illustrate this, FIG. 10 shows schematically a device for working a strand with substantially square cross-section. The strand 6 is worked by means of two rolls 12, 13, which are provided with grooves 14, the configuration of which corresponds to the shape of the strand at two diagonally opposite corners. The grooves 14 are given such a depth, that they together substantially enclose the strand, which is being worked, also along its sides. When several roll pairs similar to the rolls 12, 13 are arranged one after the other, the axles of such roll pairs can form an angle of 90° with each other in order to work the strand symmetrically.

Figure 11:
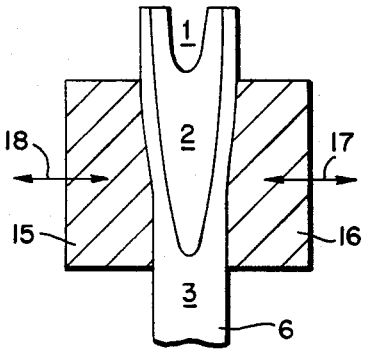
FIG. 11 is a schematic longitudinal cross-sectional view of such a strand during deformation.

A further embodiment of the invention is shown schematically in FIG. 11. A strand 6 is worked here by means of two opposed reciprocating forging tools 15, 16 with working surfaces facing toward each other, which surfaces between themselves form a space adjusted to the shape of the strand and to the type of working, to which the strand is to be subjected. Said space tapers to wedge shape in the direction of strand movement in order to subject the strand to the desired reduction with respect to its cross-section area. The arrows 17, 18 in FIG. 11 indicate the direction of movement of the tools 15, 16. At this device, the strand 6 is advanced one step when the forging tools 15, 16 move away from each other, and is deformed when said tools move toward each other. By working the strand by means of forging tools 16, 17 conical in the longitudinal direction of the strand 6, an almost continuous reduction of the cross-section of the strand is obtained.

The working surfaces of the forging tools 15, 16 can, perpendicularly to the longitudinal direction of the strand 6, be formed plane, convex or concave, depending on the corss-sectional shape of the strand 6.

Figure 12:
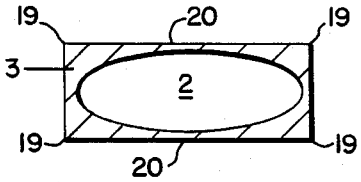
FIGS. 12 and 13 are each schematic cross-sectional views of a strand in different solidification phases.
Figure 13:
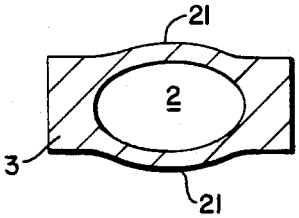
Figure 14:
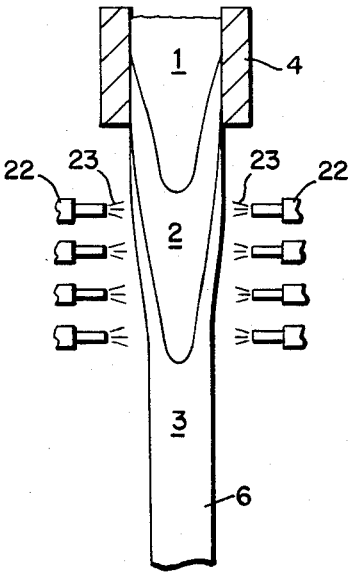
FIG. 14 is a schematic longitudinal sectional view of a strand in which a device for thermal reduction of the strand cross-section is shown.

According to a further embodiment of the invention, the reduction of the cross-section of the strand 6 is effected by controlled cooling of the strand 6 as illustrated in FIG. 14. Immediately after its leaving the mold 4, (FIG. 14), the strand 6 has a cross-section corresponding to the inner form of the mold 4. In FIG. 12 a rectangular cross-section of a strand is shown as an example. The corners 19 and the areas immediately adjacent thereto are colder than the center on the broad sides 20 of the strand 6 and the material inside thereof. The solidification process is shown by way of example in FIG. 12, with solidified material 3 at the colder portions and semi-solidified material 2 in the interior of the strand. Due to this temperature difference, the strand is thinner adjacent the corners 19 than at its center, because solidification shrinkage and cooling shrinkage have occurred adjacent the corners 19, whereby the strand assumes a convex appearance as shown in FIG. 13. According to this embodiment, a reduction of the cross-section area of the strand 6 is obtained thereby, that the broad sides of the strand 6 are subjected to forced cooling, whereby the surface layer of the convex portions and solidified material 21 inside thereof are contracted and deform the centrally located semi-solidified material. Thereby the necessary deformation of the strand is obtained. The cooling, thus, is started during the final solidification phase of the strand, as appears from above.

This embodiment can be applied also to strands with other cross-sections. In the case of square, octagonal, round or like shape of the strand, the forced cooling is carried out so that all sides or outer surfaces of the strand are cooled. This implies, that the entire outer shell of the strand shrinks as a result of the cooling shrinkage, whereby the necessary reduction of the cross-section takes place and the inner semi-solidified strand material is deformed. This is possible by controlling the cooling shrinkage terms in equation (13) in a positive manner according to the above theoretical model.

The forced cooling in the apparatus of FIG. 14 is effected by a plurality of nozzles 22 which eject coolant 23 against the strand 6 in the above indicated places. The coolant may be water, water-air mixture or steam.

The invention may be embodied in other specific forms without departing from the spirit or essential characteristics thereof. The present embodiment is therefore to be considered in all aspects as illustrative and not restrictive, the scope of the invention being indicated by the appended claims rather than by the foregoing description, and all changes which come within the meaning and range of equivalency of the claims are therefore intended to be embraced therein. The mechanic plastic working, for example, can be varied in different ways, and also the cooling device, if cooling is used for bringing about the cross-section reduction, can be modified in a suitable way within the scope of the invention.

What is claimed is:

1. A method of preventing the formation of segregations in continuous casting of steel and metal alloys in a strand cast from molten metal, where the cast strand is formed from a molten metal introduced, through a casting chill and undergoing solidification to a solid strand, characterized by physically deforming the cast strand plastically, by action on its external surface, in successive steps from immediately below the chill prior to any other treatment of the strand to a point where the strand is fully solidified, controlling said deforming so that the cross-section area of the strand is reduced to an extent in each of said steps corresponding to the solidification shrinkage and cooling shrinkage of the strand at the position of said step, said deforming steps substantially avoiding upward and downward transport of melt in the strand from the chill to the point where the strand is fully solidified.

2. A method according to claim 1, characterized in that said deforming is carried out in order to provide a fully solidified strand in a vertical direction.

3. A method according to claim 1, characterized in that said deforming is carried out to provide a fully solidified strand disposed in a horizontal direction.

4. A method according to claim 1, characterized in that the cast strand, by a corresponding design of the casting chill, is initially given a substantially rectangular cross-section with convex broad sides, and the deforming is carried out by means of plane rolls in at least one rolling step.

5. A method according to claim 1, at which a cast strand with rectangular cross-section is deformed plastically, characterized in that this is carried out by at least one rolling step with rolls, each having a diameter decreasing from the center to both ends.

6. A method according to claim 1, characterized in that, said reduction in cross-section is carried out at a deformation rate calculated from the following equations:

$$1 = X_C + X_S + X_P + X_{Fe} + X_{other\ elements}$$

where, $X_C$ = molar fraction of element C, $X_S$ = molar fraction of element S, $X_P$ = molar fraction of element P, $X_{Fe}$ = molar fraction of element Fe, and $X_{other\ elements}$ = molar fraction of other elements;

$$X_C = \frac{\frac{\%\ C}{M_c}}{\frac{\%\ C}{M_c} + \frac{\%\ S}{M_s} + \frac{\%\ P}{M_p} + \frac{\%\ Fe}{M_{Fe}} + \frac{\%\ E}{M_E}}$$

where,

M = molar weight of each of the designated elements identified by periodic chart subscripts and E = other alloying or non-metallic elements which are present in the melt such as Si and Mn; and further that, I. moles of E in the solid phase volume $y \cdot A = \frac{X_S \cdot y \cdot A}{V_m^S}$ II. moles of E in the liquid phase volume $(\lambda - y) \cdot A = \frac{X_L (\lambda - y) \cdot A}{V_m^L}$ III. moles of E entering domain volume $\lambda \cdot A = \frac{X_L'}{V_m^L} \cdot V_{in}$ IV. moles of E leaving domain volume $\lambda \cdot A = \frac{X_L''}{V_m^L} \cdot V_{out}$ V. moles of E in the solid phase $y \cdot A$ after solidification of incremental volume $dy \cdot A = \frac{(y + dy)(X_S + dX_S)}{V_m^S} \cdot A$ VI. moles of E in the liquid phase $(\lambda - y) \cdot A$ after solidification of incremental volume $dy \cdot A = \frac{[\lambda - (y + dy)][X_L + dX_L]}{V_m^L} \cdot A$ where, $y \cdot A$ = volume of the solid phase of a solid/liquid domain having a length $\lambda$ and an area A wherein the solid phase length is y;

$(\lambda - y) \cdot A$ = volume of the liquid phase of solid/liquid domain wherein the liquid phase length is $(\lambda - y)$;

dy = the incremental volume of said domain solidifying during a given time period;

$X_S$ = molar fraction of E in the solid phase volume $y \cdot A$;

$V_m^S$ = molar volume of the solid phase $y \cdot A$;

$X_L$ = molar fraction of E in the liquid phase volume $(\lambda - y) \cdot A$;

$V_m^L$ = molar volume of the liquid phase $(\lambda - y) \cdot A$;

$V_{in}$ = volume of liquid entering the domain volume $\lambda \cdot A$;

$V_{out}$ = volume of liquid leaving the domain volume $\lambda \cdot A$;

then summarizing:

$$I + II + III - IV = V + VI$$

where, the symbolized terms are as above defined; and further wherein, $$S_{sh} = \left[ \frac{V_m^L}{V_m^S} - 1 \right] dy \cdot A$$

where, $S_{sh}$=the solidification shrinkage when incremental volume dy·A solidifies;

and wherein, deformation rate=solidification shrinkage+cooling shrinkage in the semi-solidified area−cooling shrinkage in the surrounding solid area; and at the condition $$V_{in}=V_{out}=0.$$

7. A method according to claim 1, characterized in that, said reduction in cross-section area is in the range of from 1% to 10% and is carried out in 20 to 40 successive steps.

8. A method according to claim 1, characterized in that said controlling step is carried out according to the following equation:

deformation rate=solidification shrinkage and cooling shrinkage in the semi-solidified area−cooling shrinkage in the surrounding solid area.

* * * * *

UNITED STATES PATENT AND TRADEMARK OFFICE

CERTIFICATE OF CORRECTION

PATENT NO. : 4,519,439

DATED : May 28, 1985

INVENTOR(S) : Fredriksson et al.

It is certified that error appears in the above-identified patent and that said Letters Patent is hereby corrected as shown below:

Title page -change the name of Assignee from "Jernjontoret" to --Jernkontoret--.

Signed and Sealed this

*Twenty-sixth* Day of *November 1985*

[SEAL]

*Attest:*

DONALD J. QUIGG

*Attesting Officer*

*Commissioner of Patents and Trademarks*